United States Patent [19]

Taylor

[11] 4,219,692

[45] Aug. 26, 1980

[54] ELECTRIC FURNACE HEATER ASSEMBLY

[75] Inventor: Albert M. Taylor, Shelbyville, Ind.

[73] Assignee: Wellman Thermal Systems Corporation, Shelbyville, Ind.

[21] Appl. No.: 926,447

[22] Filed: Jul. 20, 1978

[51] Int. Cl.[2] ..... F27D 11/02; H05B 3/00

[52] U.S. Cl. ..... 13/25

[58] Field of Search ..... 13/20, 22, 25; 338/279, 338/280, 283, 285, 277; 219/402, 408, 388

[56] References Cited

U.S. PATENT DOCUMENTS 2,155,691 4/1939 Stevenson ..... 13/25

3,939,296 2/1976 Burger et al. ..... 13/25

*Primary Examiner*—Roy N. Envall, Jr.

*Attorney, Agent, or Firm*—Fitch, Even & Tabin

[57] ABSTRACT

A free-standing, electric heater assembly for an electric furnace includes a heating element support structure of refractory material in the shape of an I-beam. Ceramic rods are inserted through holes in the I-beam web and cemented in place to support the electric heating element. One of the I-beam flanges serves as a base for the assembly while the second flange serves to protect the heating element from damage from falling materials in the furnace.

6 Claims, 3 Drawing Figures

ELECTRIC FURNACE HEATER ASSEMBLY

BACKGROUND OF THE INVENTION

The present invention relates to electric furnace heaters, and more particularly, to an electric heater assembly for installation in the base of such a furnace.

Problems associated with providing a heat source in the base of an electric furnace are longstanding. Typically, once a furnace is constructed, accessibility of the heat source is, at best, achieved with much difficulty. The problem is compounded by the failing, in service, of such heaters, often inexplicably. Often times, however, heater failure results from falling materials, sometimes parts being processed, and other times debris, impacting the heater unit.

It is, therefore, desirable to provide an electric resistant heater assembly for use in the base of an electric furnace wherein protection is provided the heater against materials falling from above.

Accordingly, it is an object of the present invention to provide an electric heater assembly, a module, for use in the base of an electrically heated furnace, the assembly being free-standing and including heater support structure providing means for shielding the heating element from falling debris.

SUMMARY OF THE INVENTION

In accordance with the present invention, there is provided a free-standing, electric heater assembly for removable installation in the base of an electric furnace below the level of materials placed therein for processing. An electric resistance heating element and refractory means for supporting the heating element are provided. The refractory means includes means for shielding the heating element from material which may fall from above in the furnace.

BRIEF DESCRIPTION OF THE DRAWING

The preferred embodiment of the invention is shown in the accompanying drawing in which.

DESCRIPTION OF THE PREFERRED EMBODIMENT

Figure 1:
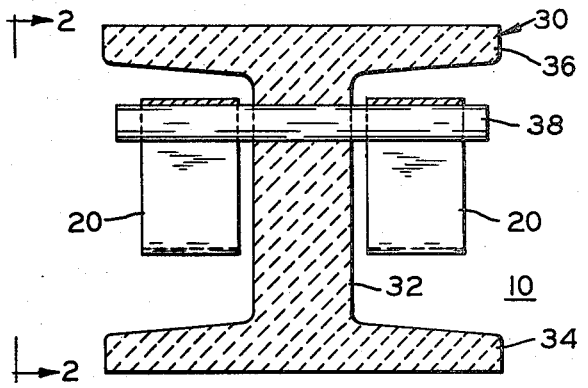
FIG. 1 is an end view of the heater assembly generally as seen along line 1—1 in FIG. 2.
Figure 2:
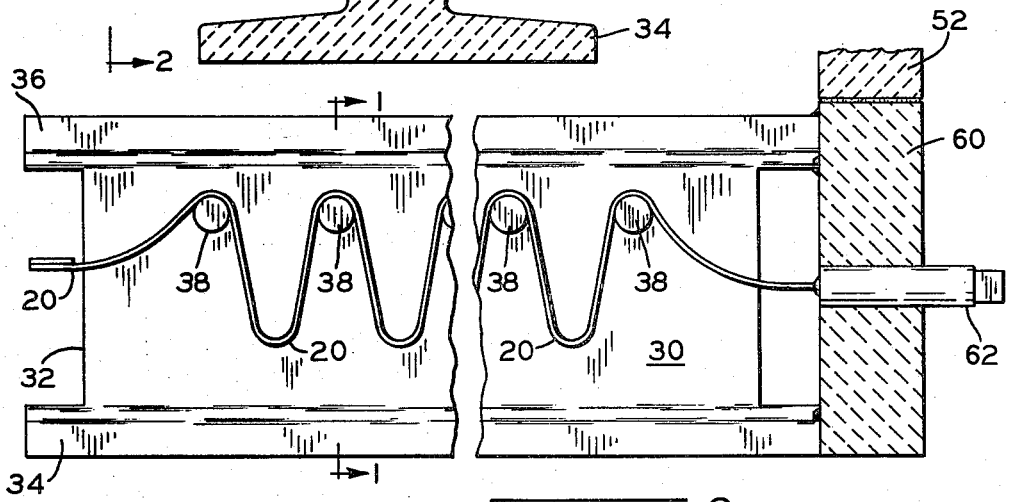
FIG. 2 is a side elevation view of the heater assembly generally as seen along line 2—2 in FIG. 1 and with the heater assembly mounted in a furnace.

Referring to FIG. 1, there is shown a free-standing electric heater assembly 10 in accordance with the present invention. Included is an electric resistance heating element 20 and refractory means for supporting the heating element in the form of an I-beam 30 cast of a refractory material. I-beam 30 includes a web section 32 and a pair of flanges 34 and 36. A plurality of ceramic rods 38 are provided protruding from the web 32 and are spaced apart along the length of the I-beam as shown in FIG. 2 for receiving the heating element 20. Flange 34 of the refractory I-beam serves as the base for the assembly and provides stability while flange 36 serves as the means for shielding the heating element from material which may fall from above in the furnace.

In the embodiment shown, ceramic rods 38 are assembled thru holes formed in the I-beam web 32 such that the ceramic rods 38 protrude an equal distance from either side of the web. This allows for the heating element 20 to be mounted upon both sides of the refractory I-beam web.

In the embodiment shown, the heating element 20 is assembled upon the ceramic rods 38 in serpentine fashion. The free ends of the heating element are connected to suitable electrical connectors for connection to a source of electrical energy (FIG. 3).

The arrangement shown has been constructed and operated satisfactorily. The heating element 20 was formed of nickel-chromium alloy (tradename Nichrome) having a thickness of 0.045 inches and a width of $1\frac{1}{2}$ inches and provided an overall resistance of 1 ohm. The refractory I-beam 30 was cast using a form provided with tubes therethru to allow it to be cast in its finished shape complete with the holes to carry the ceramic rod heating element supports 38. Refractory Moldit D, a castable refractory obtained from Combustion Engineering Inc. Valley Forge, Pa. was used for the casting. After filling the form with the casting material, the I-beam casting is allowed to dry for 24 hours and then removed from the form. The ceramic rods 38 are then cemented into position using the same castable refractory as a cement. The casting is placed in a furnace at 500 degrees F. for 24 hours, after which the temperature is raised 100 degrees F. every hour until it reaches 2,000 degrees F. The cured refractory I-beam then has a compressive strength of 20 tons per square inch; such allows the second flange 30 and the I-beam generally to serve as a load-bearing structure.

In the embodiment shown, the I-beam flanges are 8 inches wide; the I-beam structure being 7 inches high and 54 inches long. The web 32 is two inches wide; the widest part of the flange is 1 inch wide and the outermost extremities of the flanges are $\frac{3}{4}$ inch wide. The holes for receiving the ceramic rods 38 are sized to accept $\frac{3}{4}$ inch diameter ceramic rods having a length of $7\frac{3}{4}$ inches, 19 holes being provided spaced apart equally at $2\frac{1}{2}$ inches. Such an arrangement provides satisfactory operation including suitable protection to the heating element 20 from foreign materials, including materials being processed, which might otherwise fall down upon, and damage, the heating element.

Figure 3:
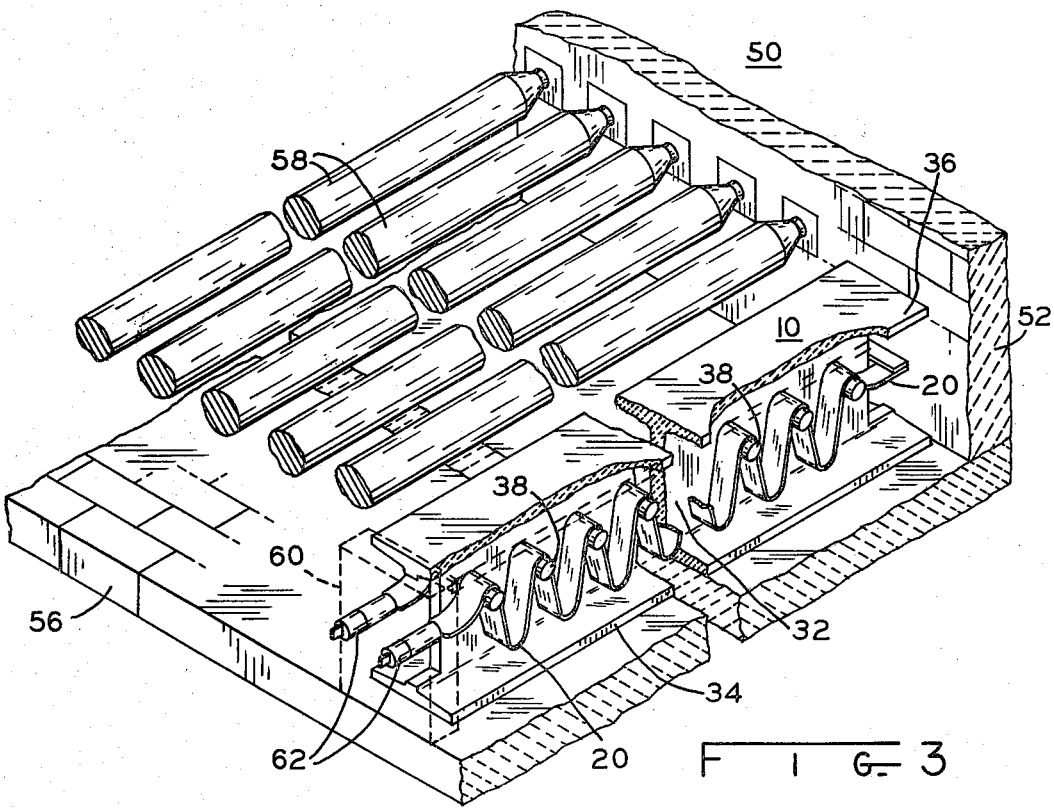
FIG. 3 shows, in perspective, a cutaway view of an electric furnace of the roller hearth type wherein the free-standing heater assembly is removably installed in the base portion.

Referring now to FIG. 3, there is shown a cutaway view of a portion of an electric roller hearth furnace 50 wherein the free-standing electric heater assembly 10 of the present invention is incorporated for removable installation in the base thereof. Furnace 50 includes a pair of insulated sidewalls, one of which is shown at 52 and an insulating base 56. A plurality of rollers 58 are provided upon which materials to be processed in the furnace are placed. The rollers 58 may be provided with drive means for passing materials through the furnace at some particular velocity. One of the sidewalls 52 is provided with an opening through which heater assembly 10 may be inserted and removed for examination or replacement. A hole-cover plate 60 of some suitable insulating material is provided for closing the opening after the heater assembly 10 is installed. Cover-plate 60 is provided with a pair of electrical conductors 62 passing therethrough for connection to the free ends of heating element 20 and to a source of electrical energy.

It is contemplated that heater assembly 10 may be installed in a standard furnace without rollers. With such an arrangement, materials to be processed in the furnace may be placed upon and supported by the refractory I-beam 30. While an embodiment and application of this invention has been shown and described, it will be apparent to those skilled in the art that modifications are possible without departing from the inventive concepts herein described. For example, it is contemplated that the refractory I-beam structure of this embodiment could be suitably replaced by a structure having a cross section triangular in shape and provided with a top cover plate, the ceramic rods being passed through and protruding from the base section. Likewise, the structure could be formed of a generally T-shaped cross section wherein the base portion is generally rectangular in cross section and is covered with a top cover plate. Both of these configurations, and others too, offer stability to the assembly as well as protection to the heating element from falling debris. The invention therefore is not to be restricted except as is necessary by the prior art and the spirit of the appended claims.

What is claimed is:

1. A free-standing electric heater assembly for removable installation in the base of an electric furnace below materials placed therein for processing comprising:

electric resistance heating means; and refractory means for supporting the heating means, said refractory means including means for shielding the heating means from material which may fall from above in the furnace.

2. The electric heater assembly of claim 1 wherein the refractory means is formed in the shape of an I-beam having a web and 1st and 2nd flanges, the web being provided with a plurality of ceramic rods protruding therefrom spaced apart along the length of the I-beam, the heating means being supported on said rods, the first flange serving as a base member and the second flange serving as the means for shielding the heating means from falling material.

3. The electric heater assembly of claim 2 wherein the I-beam is a casting.

4. The electric heater assembly of claim 2 wherein the heating means is a heating element of the ribbon type and is supported upon the ceramic rods in serpentine fashion.

5. The electric heater assembly of claim 2 wherein the ceramic rods protrude from both sides of the web for supporting the heating means to be assembled on both sides thereof.

6. The electric heater assembly of claim 2 wherein the I-beam and the second flange thereof function as a load-bearing structure.

* * * * *